US008663887B2

(12) United States Patent
Kaneda

(10) Patent No.: US 8,663,887 B2
(45) Date of Patent: Mar. 4, 2014

(54) TONER FOR DEVELOPING ELECTROSTATIC IMAGES

(75) Inventor: Takuya Kaneda, Tokyo (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 13/579,123

(22) PCT Filed: Mar. 10, 2011

(86) PCT No.: PCT/JP2011/055651

§ 371 (c)(1),
(2), (4) Date: Aug. 15, 2012

(87) PCT Pub. No.: WO2011/114985

PCT Pub. Date: Sep. 22, 2011

(65) Prior Publication Data

US 2012/0315575 A1 Dec. 13, 2012

(30) Foreign Application Priority Data

Mar. 19, 2010 (JP) ..... 2010-064836

(51) Int. Cl.
*G03G 9/08* (2006.01)

(52) U.S. Cl.
USPC ..... 430/108.8; 430/108.1

(58) Field of Classification Search
USPC ..... 430/108.8, 108.1
See application file for complete search history.

(56) References Cited

U.S. PATENT DOCUMENTS

| | | | |
|---|---|---|---|
| 5,364,722 | A | 11/1994 | Tanikawa et al. |
| 5,773,185 | A | 6/1998 | Yachi et al. |
| 2005/0129640 | A1 | 6/2005 | Laurent |

FOREIGN PATENT DOCUMENTS

| | | | |
|---|---|---|---|
| CN | 1070490 | A | 3/1993 |
| CN | 1669550 | A | 9/2005 |
| JP | 06-230600 | A | 8/1994 |
| JP | 09-050150 | A | 2/1997 |
| JP | 11-002917 | A | 1/1999 |
| JP | 2002-139863 | A | 5/2002 |
| JP | 2002-229251 | A | 8/2002 |
| JP | 2009-031467 | A | 2/2009 |
| JP | 2011-048315 | A | 3/2011 |

OTHER PUBLICATIONS

International Search Report of PCT/JP2011/055651, mailing date of Apr. 5, 2011.

*Primary Examiner* — Hoa V Le
(74) *Attorney, Agent, or Firm* — Westerman, Hattori, Daniels & Adrian, LLP

(57) ABSTRACT

The present invention is to provide a toner for developing electrostatic images having excellent fixability, peelability, shelf stability (blocking resistance), printing durability, printing durability after being left at high temperature and thin line reproducibility. A toner for developing electrostatic images, comprising colored resin particles comprising a binder resin, a colorant and a wax, wherein the wax contains a natural sunflower wax, and wherein the natural sunflower wax has an acid value of 10 mg KOH/g or less, and a content of the natural sunflower wax is in the range from 1 to 10 parts by weight with respect to 100 parts by weight of the binder resin.

8 Claims, No Drawings

TONER FOR DEVELOPING ELECTROSTATIC IMAGES

TECHNICAL FIELD

The present invention relates to a toner for developing electrostatic images used for development of electrostatic latent images formed on a photosensitive member in an electrophotography-type (including electrostatic printing-type) image forming device.

Particularly, the present invention relates to a toner for developing electrostatic images, comprising a natural sunflower wax, and having excellent fixability, peelability, shelf stability (blocking resistance), printing durability, printing durability after being left at high temperature and thin line reproducibility.

BACKGROUND ART

In recent years, there has been growing demands for electrophotography-type image-forming devices which use toners for developing electrostatic images, such as copying machines and printers, to increase printing speed, decrease power consumption and provide long-term image stability. Measures have been taken to respond to the demands for increase in printing speed and decrease in power consumption, such as designing a toner composition to provide a toner with a low fixing temperature. However, such a toner composition causes toner aggregation, decrease in blocking resistance and decrease in peelability from a fixing roller. Therefore, there is still a demand for a toner having high shelf stability and peelability.

To respond to the demand for long-term image stability, it is important to improve printing durability and thin line reproducibility of toners.

In recent years, there is also an increasing demand for image-forming devices in areas where the average temperature is high; therefore, there is a demand for a toner which is able to exhibit high long-term printing durability even under a high temperature condition.

It has been known that a wax is contained in toner particles to lower the fixing temperature of a toner. Patent Literature 1 discloses a toner for electrophotography comprising a plant-derived natural wax such as a carnauba wax, a candelilla wax or the like.

It has also been known that a natural wax is used in combination with a synthetic hydrocarbon wax to take a balance of fixability and peelability. Patent Literature 2 discloses a dry toner comprising a plant wax and a synthetic hydrocarbon wax.

CITATION LIST

Patent Literature

Patent Literature 1: Japanese Patent Application Laid-Open (JP-A) No. H6-230600

Patent Literature 2: JP-A No. H11-2917

SUMMARY OF INVENTION

Technical Problem

The toner for electrophotography disclosed in Patent Literature 1, as shown in Table 1 of Patent Literature 1, has a lower limit of a non-offset temperature of 140 to 145° C. However, as shown in Table 1, fixing strength is not necessary high.

The dry toner disclosed in Patent Literature 2, as shown in Table 5 of Patent Literature 2, has a slightly low image quality in a fine part after 20,000 printings.

The present invention has been made in view of the above circumstances, and it is an object of the present invention to provide a toner for developing electrostatic images having excellent fixability, peelability, shelf stability (blocking resistance), printing durability, printing durability after being left at high temperature and thin line reproducibility.

Solution to Problem

As a result of diligent researches, in order to solve the above problems, the inventor of the present invention found out that by containing a natural sunflower wax in colored resin particles, there can be improved fixability, peelability, shelf stability (blocking resistance), printing durability, printing durability after being left at high temperature and thin line reproducibility. Based on the above knowledge, the inventor has reached the present invention.

That is, the toner for developing electrostatic images of the present invention is a toner for developing electrostatic images, comprising colored resin particles comprising a binder resin, a colorant and a wax, wherein the wax contains a natural sunflower wax, and wherein the natural sunflower wax has an acid value of 10 mg KOH/g or less, and a content of the natural sunflower wax is in the range from 1 to 10 parts by weight with respect to 100 parts by weight of the binder resin.

The toner for developing electrostatic images having such a composition contains an appropriate amount of the natural sunflower wax, thereby having high fixability, peelability, shelf stability (blocking resistance), printing durability, printing durability after being left at high temperature and thin line reproducibility, compared to the conventional toner containing other natural waxes, a petroleum wax and/or a synthetic ester wax.

In the present invention, the wax further contains a petroleum wax, and the content of the petroleum wax may be in the range from 1 to 10 parts by weight with respect to 100 parts by weight of the binder resin.

In the present invention, the wax further contains a synthetic ester wax, and the content of the synthetic ester wax may be in the range from 1 to 10 parts by weight with respect to 100 parts by weight of the binder resin.

In the present invention, it is preferable that the natural sunflower wax has one melting point (TmD) which is defined by an endothermic peak temperature upon temperature rise that is measured by a differential scanning type calorimeter (DSC), and wherein a half-value width of the endothermic peak is 8° C. or less.

The toner for developing electrostatic images having such a composition contains the natural sunflower wax having excellent sharp melt property, thereby improving low-temperature fixability.

In the present invention, the melting point (TmD) of the natural sunflower wax is preferably in the range from 70 to 85° C., the melting point is defined by the endothermic peak temperature upon temperature rise that is measured by the differential scanning type calorimeter (DSC).

The toner for developing electrostatic images having such a composition can especially keep low-temperature fixability and blocking resistance at a high level. Also, in the toner for developing electrostatic images having such a composition, aggregation could rarely occur upon producing the toner.

In the present invention, the colored resin particles may be produced by a wet method.

In the present invention, the colored resin particles may have a core-shell structure.

Advantageous Effects of Invention

According to the present invention, the toner for developing electrostatic images of the present invention contains an appropriate amount of the natural sunflower wax, thereby having high fixability, peelability, shelf stability (blocking resistance), printing durability, printing durability after being left at high temperature and thin line reproducibility, compared to the conventional toner containing other natural waxes, a petroleum wax and/or a synthetic ester wax.

DESCRIPTION OF EMBODIMENTS

The toner for developing electrostatic images of the present invention is a toner developing electrostatic images, comprising colored resin particles comprising a binder resin, a colorant and a wax, wherein the wax contains a natural sunflower wax, and wherein the natural sunflower wax has an acid value of 10 mg KOH/g or less, and a content of the natural sunflower wax is in the range from 1 to 10 parts by weight with respect to 100 parts by weight of the binder resin.

Hereinafter, the toner for developing electrostatic images of the present invention may be simply referred to as "toner".

In the toner comprising a natural wax such as a carnauba wax or the like as disclosed in Patent Literature 1, peelability with a fixing roller is insufficient as described in Examples below. Also in the conventional toner comprising a plant wax and s synthetic hydrocarbon wax as disclosed in Patent Literature 2, the waxes are exposed upon pulverization, so that there could be a decrease in shelf stability and printing durability.

To the contrary, the toner of the present invention contains a natural sunflower wax, thereby improving fixability, peelability, shelf stability (blocking resistance), printing durability, printing durability after being left at high temperature and thin line reproducibility, as described in Examples below.

The toner of the present invention comprises colored resin particles comprising a binder resin, a colorant and a predetermined amount of a natural sunflower wax.

Hereinafter, there will be described in order a method for producing colored resin particles, the colored resin particles obtained by said production method, and a toner of the present invention obtained by an external addition process of the colored resin particles.

1. Method for Producing Colored Resin Particles

Generally, methods for producing the colored resin particles are broadly classified into dry methods such as a pulverization method and wet methods such as an emulsion polymerization agglomeration method, a dispersion polymerization method, a suspension polymerization method and a solution suspension method. Among the above methods, the wet methods are preferable since toners having excellent printing performance such as the thin line reproducibility can be easily obtained. Among the wet methods, polymerization methods such as the emulsion polymerization agglomeration method, the dispersion polymerization method and the suspension polymerization method are preferable since toners having relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticle with a colorant dispersion liquid, etc. The solution suspension method is a method for producing colored resin particles by forming droplets of a solution in an aqueous medium, the solution in which toner components such as a binder resin, a colorant and a wax are dissolved or dispersed in an organic solvent, and removing the organic solvent. In the present invention, both methods can be performed by the above known methods.

The colored resin particles of the present invention can be produced by employing the wet methods or the dry methods. In the case of employing "(A) Suspension polymerization method" preferable among the wet methods or "(B) Pulverization method" typical among the dry methods, the following processes are performed.

(A) Suspension Polymerization Method (A-1) Preparation Process of Polymerizable Monomer Composition First, a polymerizable monomer, a colorant, a natural sunflower wax and other additives which are added if required, are mixed and dissolved. Thereby, a polymerizable monomer composition is prepared. For mixing upon preparing the polymerizable monomer composition, a media type dispersing machine is used, for example.

In the present invention, the polymerizable monomer means a monomer having a polymerizable functional group and the polymerizable monomer is polymerized to be a binder resin. As a main component of the polymerizable monomer, a monovinyl monomer is preferably used. Examples of the monovinyl monomer include: styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; amide compounds such as acrylamide and methacrylamide; and olefins such as ethylene, propylene and butylene. These monovinyl monomers may be used alone or in combination of two or more kinds.

Among them, styrene, styrene derivatives, acrylic acid esters and methacrylic acid esters are suitably used.

In order to improve the shelf stability of the toner (blocking resistance), as part of the polymerizable monomer, any crosslinkable polymerizable monomer is preferably used together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ethylenic unsaturated carboxylic acid esters such as ethylene glycol dimethacrylate and diethylene glycol dimethacrylate; divinyl compounds such as N,N-divinylaniline and divinyl ether; and compounds having three or more vinyl groups such as trimethylolpropane trimethacrylate and dimethylolpropane tetraacrylate. These crosslinkable polymerizable monomers may be used alone or in combination of two or more kinds.

In the present invention, it is desirable that the amount of the crosslinkable polymerizable monomer to be used is generally in the range from 0.1 to 5 parts by weight, preferably from 0.3 to 2 parts by weight, with respect to 100 parts by weight of the monovinyl monomer.

Further, as part of the polymerizable monomer, any macromonomer is preferably used together with the monovinyl monomer so that the balance of the shelf stability and low-temperature fixability of the toner can be improved. The macromonomer is a reactive oligomer or polymer having a polymerizable carbon-carbon unsaturated bond at the end of a polymer chain and generally having a number average molecular weight (Mn) of 1,000 to 30,000. As the macromonomer, an oligomer or polymer having higher glass transition temperature (Tg) than that of a polymer (binder resin) obtained by polymerization of the polymerizable monomer is preferably used.

In the present invention, it is desirable that the amount of the macromonomer to be used is generally in the range from 0.01 to 10 parts by weight, preferably from 0.03 to 5 parts by weight, more preferably from 0.1 to 2 parts by weight, with respect to 100 parts by weight of the monovinyl monomer.

In the present invention, a colorant is used. As a color toner, four types of toners including a black toner, a cyan toner, a yellow toner and a magenta toner are generally used. To produce the colored toner, a black colorant, a cyan colorant, a yellow colorant and a magenta colorant each can be used.

In the present invention, examples of the black colorant to be used include pigments including carbon black, titanium black, magnetic powder such as zinc-iron oxide and nickel-iron oxide.

Examples of the cyan colorant to be used include compounds such as copper phthalocyanine pigments, derivatives thereof and anthraquinone pigments. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used include compounds including azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 238 and 251, and C. I. Pigment Violet 19.

These colorants can be used alone or in combination of two or more kinds. In the present invention, it is desirable that the amount of the colorant to be used is in the range from 1 to 10 parts by weight with respect to 100 parts by weight of the polymerizable monomer.

One of the main features of the present invention is that the wax contains a natural sunflower wax.

The natural sunflower wax is a wax extracted from sunflowers. The main component of the natural sunflower wax is a fatty acid monoester in which the peak of carbon atoms attributed to fatty acid is 20 to 24, and the peak of carbon atoms attributed to aliphatic alcohol is 24 to 28. As shown in Table 1 of Examples described below, the natural sunflower wax has less carbon atoms and a narrower melting point distribution than other natural waxes which are conventionally used for the toner, such as a carnauba wax and a candelilla wax. It is presumed from such characteristics that a toner quality that conventional natural waxes cannot attain can be realized by changing the degree of wax seepage from fixed toner particles.

As specifically described in Examples below, the toner of the present invention containing the natural sunflower wax has more excellent fixability, peelability, shelf stability (blocking resistance), printing durability, printing durability after being left at high temperature and thin line reproducibility than the conventional toner containing other natural waxes. This is considered attributable to the change in the degree of wax seepage from fixed toner particles. As specifically described in Examples below, the toner of the present invention containing the natural sunflower wax has more excellent fixability than the conventional toner containing only the petroleum wax and the synthetic ester wax.

The natural sunflower wax is a wax extracted from sunflowers and may be obtained by being extracted from sunflower seeds and being purified. However, commercial available waxes can be also used.

A method for extracting the natural sunflower wax from sunflower seeds is as follows. First, a crude wax is only extracted from a crude sunflower oil obtained by pressing sunflower seeds. By purifying the crude wax, a natural sunflower wax is obtained. As needed, a main component of the extracted wax may be distilled to remove components having a low boiling point.

The natural sunflower wax used in the present invention has an acid value of 10 mg KOH/g or less. The natural sunflower wax having an acid value of more than 10 mg KOH/g is not preferable since it contains a large amount of free fatty acid and it is highly likely to become liquid.

The acid value of the natural sunflower wax is preferably 5 mg KOH/g or less, more preferably in the range from 0.5 to 3 mg KOH/g.

The content of the natural sunflower wax used in the present invention is in the range from 1 to 10 parts by weight with respect to 100 parts by weight of the binder resin. If the content is less than 1 part by weight, the fixability and peelability of the toner, which are the advantages of the present invention, cannot be exhibited. If the content exceeds 10 parts by weight, filming is likely to occur on a member of a development part in the image forming device, and printing durability tends to decrease.

The content of the natural sunflower wax is preferably in the range from 2 to 9 parts by weight, more preferably from 3 to 8 parts by weight, with respect to 100 parts by weight of the binder resin.

It is preferable that the natural sunflower wax has one melting point (TmD) which is defined by an endothermic peak temperature upon temperature rise that is measured by a differential scanning type calorimeter (DSC), and wherein a half-value width of the endothermic peak is 8° C. or less. As described above, by using the natural sunflower wax having excellent sharp melt property, low-temperature fixability can be improved.

The half-value width of the endothermic peak is preferably 7° C. or less, more preferably 6° C. or less.

The melting point (TmD) of the natural sunflower wax is preferably in the range from 70 to 85° C. The melting point (TmD) is a melting point which is defined by the endothermic peak temperature upon temperature rise that is measured by the differential scanning type calorimeter (DSC).

In the natural sunflower wax having a melting point (TmD) of less than 70° C., blocking resistance may decrease. On the other hand, in the natural sunflower wax having a melting point (TmD) of more than 85° C., a melting is slow upon fixing the toner. Therefore, there could be a decrease in low-temperature fixability.

The melting point (TmD) is preferably in the range from 70 to 80° C., more preferably from 75 to 80° C.

The wax may further contain a petroleum wax. The acid value of the petroleum wax used in the present invention is preferably 5 mg KOH/g or less. The melting point (TmD) of the petroleum wax used in the present invention is in the range from 60 to 90° C., and the half-value width of the melting point peak is preferably 8° C. or less.

Specific examples of the petroleum wax include a paraffin wax, a microcrystalline wax and a petrolatum. As the commercial available petroleum wax, HNP-11 (product name; manufactured by: Nippon Seiro Co., Ltd.), HNP-9 (product name; manufactured by: Nippon Seiro Co., Ltd.), PW-140 (product name; manufactured by: Nippon Seiro Co., Ltd.), SP-0160 (product name; manufactured by: Nippon Seiro Co., Ltd.) or the like can be used.

In the case of using the petroleum wax, the content of the petroleum wax is preferably in the range from 1 to 10 parts by weight with respect to 100 parts by weight of the binder resin.

The wax may further contain a synthetic ester wax. The acid value of the synthetic ester wax is preferably 5 mg KOH/g or less. The melting point (TmD) of the synthetic ester wax used in the present invention is preferably in the range from 60 to 85° C., more preferably from 65 to 75° C.

Specific examples of the synthetic ester wax include polyalcohol ester compounds including: pentaerythritol ester such as pentaerythritol tetramyristate, pentaerythritol tetrapalmitate, pentaerythritol tetrastearate and pentaerythritol tetralaurate; and dipentaerythritol ester such as dipentaerythritol hexamyristate, dipentaerythritol hexapalmitate and dipentaerythritol hexylaurate. As the commercial available synthetic ester wax, WEP-7 (product name; manufactured by: NOF Corporation; melting point: 70° C.), WEP-4 (product name; manufactured by: NOF Corporation; melting point: 71° C.) WEP-6 (product name; manufactured by: NOF Corporation; melting point: 77° C.) or the like can be used.

In the case of using the synthetic ester wax, the content of the synthetic ester wax is preferably in the range from 1 to 10 parts by weight with respect to 100 parts by weight of the binder resin.

The natural sunflower wax may be used alone or in combination of two or more kinds. In the case of using the petroleum wax and/or synthetic ester wax, one kind of the petroleum wax or synthetic ester wax may be used in combination with the natural sunflower wax, two or more kinds of the petroleum waxes and/or synthetic ester waxes may be used in combination with the natural sunflower wax.

In the case of using the natural sunflower wax in combination with the petroleum wax and/or synthetic ester wax, it is desirable that the total content of the waxes is in the range from 3 to 30 parts by weight with respect to 100 parts by weight of the monovinyl monomer. If the total content of the waxes is less than 3 parts by weight with respect to 100 parts by weight of the monovinyl monomer, there could not be obtained sufficient releasing characteristics. If the total content of the waxes exceeds 30 parts by weight, there could be a decrease in shelf stability of the toner.

The total content of the waxes is more preferably in the range from 4 to 20 parts by weight, furthermore preferably from 5 to 10 parts by weight, with respect to 100 parts by weight of the monovinyl monomer.

In the case of using the natural sunflower wax in combination with the petroleum wax and/or synthetic ester wax, the content ratio of the natural sunflower wax is preferably 50 parts by weight or more with respect to the total content of the waxes.

As described in Examples below, it is particularly preferable to use the natural sunflower wax, the petroleum wax and the synthetic ester wax in combination.

As one of other additives, a charge control agent having positively charging ability or negatively charging ability can be used to improve the charging ability of the toner.

The charge control agent is not particularly limited as long as it is generally used as a charge control agent for the toner. Among the charge control agents, a charge control resin having positively charging ability or negatively charging ability is preferably used since the charge control resin is highly compatible with the polymerizable monomer and can impart stable charging ability (charge stability) to the toner particles. From the viewpoint of obtaining a positively-chargeable toner, the charge control resin having positively charging ability is more preferably used.

In the present invention, it is desirable that the amount of the charge control agent to be used is generally in the range from 0.01 to 10 parts by weight, preferably from 0.03 to 8 parts by weight, with respect to 100 parts by weight of the monovinyl monomer. If the added amount of the charge control agent is less than 0.01 part by weight, fog may occur. On the other hand, if the added amount of the charge control agent exceeds 10 parts by weight, printing soiling may occur.

As one of other additives, a molecular weight modifier is preferably used.

The molecular weight modifier is not particularly limited as long as it is generally used as a molecular weight modifier for the toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally in the range from 0.01 to 10 parts by weight, preferably from 0.1 to 5 parts by weight, with respect to 100 parts by weight of the monovinyl monomer.

(A-2) Suspension Process of Obtaining Suspension (Droplets Forming Process)

The polymerizable monomer composition obtained by "(A-1) Preparation process of polymerizable monomer composition" is suspended in an aqueous dispersion medium to obtain a suspension (polymerizable monomer composition dispersion liquid). Herein, "suspension" means that droplets of the polymerizable monomer composition are formed in the aqueous dispersion medium. Dispersion treatment for forming the droplets can be performed by means of a device capable of strong stirring such as an in-line type emulsifying and dispersing machine (product name: EBARA MILDER; manufactured by: Ebara Corporation), and a high-speed emulsification dispersing machine (product name: T. K. HOMOMIXER MARK II; manufactured by: PRIMIX Corporation).

In the present invention, a dispersion stabilizer is preferably added in the aqueous dispersion medium upon forming the droplets to control particle diameters and improve circularity of the colored resin particle.

The aqueous dispersion medium may be water alone, or any of water-soluble solvents such as lower alcohols and lower ketones can be used together with water.

Examples of the dispersion stabilizer include: sulfates such as barium sulfate and calcium sulfate; carbonates such as barium carbonate, calcium carbonate and magnesium carbonate; phosphates such as calcium phosphate; metallic compounds including metallic oxides such as aluminum oxide and titanium oxide, and metallic hydroxides such as aluminum hydroxide, magnesium hydroxide and iron(II) hydroxide; water-soluble polymer compounds such as polyvinyl alcohol, methyl cellulose and gelatin; and organic polymer compounds such as anionic surfactants, nonionic surfactants and ampholytic surfactants.

Among the above dispersion stabilizers, dispersion stabilizers containing colloid of hardly water-soluble metal hydroxide (hardly water-soluble inorganic compound), which are dissolved in an acid solution, are preferably used. The above dispersion stabilizers can be used alone or in combination of two or more kinds.

The added amount of the dispersion stabilizer is preferably in the range from 0.1 to 20 parts by weight, more preferably from 0.2 to 10 parts by weight, with respect to 100 parts by weight of the polymerizable monomer.

Examples of a polymerization initiator used in the polymerization of the polymerizable monomer composition include: inorganic persulfates such as potassium persulfate and ammonium persulfate; azo compounds such as 4,4'-azobis(4-cyanovaleric acid), 2,2'-azobis(2-methyl-N-(2-hydroxyethyl)propionamide, 2,2'-azobis(2-amidinopropane) dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylhexanoate, t-butylperoxypyvalate, diisopropylperoxydicarbonate, di-t-butylperoxyisophthalate and t-butylperoxyisobutyrate. Among them, the organic peroxides are preferably used. If the organic peroxides are used, the toner having less odor and excellent image quality can be obtained.

The polymerization initiator may be added after dispersing the polymerizable monomer composition to dispersion stabilizer and before forming droplets, or may be directly added to the polymerizable monomer composition.

The added amount of the polymerization initiator is preferably in the range from 0.1 to 20 parts by weight, more preferably from 0.3 to 15 parts by weight, furthermore preferably from 1.0 to 10 parts by weight, with respect to 100 parts by weight of the monovinyl monomer. If the added amount of the polymerization initiator is less than 0.1 part by weight, there could be a decrease in fixability. On the other hand, if the added amount of the polymerization initiator exceeds 20 parts by weight, there could be a decrease in shelf stability.

(A-3) Polymerization Process

The desirable suspension (the aqueous dispersion medium containing droplets of the polymerizable monomer composition) obtained in "(A-2) Suspension process of obtaining suspension (droplets forming process)" is heated to polymerize. Thereby, an aqueous dispersion liquid of colored resin particles can be obtained.

In the present invention, the polymerization temperature is preferably 50° C. or more, more preferably in the range from 60 to 98° C. The polymerization time is preferably in the range from 1 to 20 hours, more preferably from 2 to 15 hours, in the present invention.

In order to polymerize droplets of the polymerizable monomer composition in a stably dispersed state, the polymerization reaction may proceed while agitating the droplets for dispersion treatment in the polymerization process continuously after "(A-2) Suspension process of obtaining suspension (droplets forming process)".

The colored resin particles in the present invention are preferably colored resin particles having a core-shell structure (or "capsule type"), which are obtained by using the colored resin particles obtained by the polymerization process as a core layer and forming a shell layer, a material of which is different from that of the core layer, around the core layer.

The colored resin particles having the core-shell structure has a structure which covers the core layer including a substance having a low-softening point with a substance having a high-softening point, thereby taking a balance of lowering of fixing temperature and prevention of blocking at storage of the toner.

A method for producing the core-shell type colored resin particles mentioned above is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer (a polymerizable monomer for shell) for forming a shell layer and a polymerization initiator for shell are added to the aqueous dispersion liquid to which the colored resin particles are dispersed followed by polymerization, thus the core-shell type colored resin particles can be obtained.

As the polymerizable monomer for shell, the above-mentioned polymerizable monomer can be used. Among the polymerizable monomers, any of monomers which provide a polymer having Tg of more than 80° C. such as styrene and methyl methacrylate is preferably used alone or in combination of two or more kinds.

Examples of the polymerization initiator for shell used for polymerization of the polymerizable monomer for shell include: polymerization initiators including persulfates such as potassium persulfate and ammonium persulfate; and water-soluble azo compounds such as 2,2'-azobis-(2-methyl-N-(2-hydroxyethyl)propionamide) and 2,2'-azobis-(2-methyl-N-(1,1-bis(hydroxymethyl)-2-hydroxyethyl)propionamide).

The added amount of the polymerization initiator for shell used in the present invention is preferably in the range from 0.1 to 30 parts by weight, more preferably from 1 to 20 parts by weight, with respect to 100 parts by weight of the polymerizable monomer for shell.

The polymerization temperature of the shell layer is preferably 50° C. or more, more preferably in the range from 60 to 95° C. The polymerization time of the shell layer is preferably in the range from 1 to 20 hours, more preferably from 2 to 15 hours.

(A-4) Processes of Washing, Filtering, Dehydrating and Drying

It is preferable that the aqueous dispersion liquid of the colored resin particles obtained after "(A-3) Polymerization process" is subjected to a series of operations including washing, filtering, dehydrating, and drying several times as needed according to any conventional method.

First, in order to remove the dispersion stabilizer remained in the aqueous dispersion liquid of the colored resin particles, acid or alkali is added to the aqueous dispersion liquid of the colored resin particles to wash.

If the dispersion stabilizer being used is an acid-soluble inorganic compound, acid is added to the aqueous dispersion liquid of the colored resin particles. On the other hand, if the dispersion stabilizer being used is an alkali-soluble inorganic compound, alkali is added to the aqueous dispersion liquid of the colored resin particles.

(B) Pulverization Method

In the case of producing the colored resin particles by employing the pulverization method, the following processes are performed.

First, a binder resin, a colorant, a natural sunflower wax and other additives which are added if required, are mixed by means of a mixer such as a ball mill, a V type mixer, Henschel Mixer (product name), a high-speed dissolver, an internal mixer or a whole burg internal mixer. Next, the above-obtained mixture is kneaded while heating by means of a press kneader, a twin screw kneading machine or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as a wind classifier or an airflow classifier. Thus, colored resin particles produced by the pulverization method can be obtained.

The binder resin, the colorant, the natural sunflower wax and other additives which are added if required, used in "(A) Suspension polymerization method" can be used in the pulverization method. Similarly as the colored resin particles obtained by "(A) Suspension polymerization method", the colored resin particles obtained by the pulverization method can also be in a form of the core-shell type colored resin particles produced by a method such as the in situ polymerization method.

As the binder resin, other resins which are conventionally used for the toner can be used. Specific examples of the binder resin used in the pulverization method include polystyrene, styrene-butyl acrylate copolymers, polyester resins and epoxy resins.

2. Colored Resin Particles

The colored resin particles can be obtained by "(A) Suspension polymerization method" or "(B) Pulverization method".

Hereinafter, the colored resin particles constituting the toner will be described. The colored resin particles include both core-shell type colored resin particles and colored resin particles which are not core-shell type.

The volume average particle diameter (Dv) of the colored resin particles constituting the toner is preferably in the range from 4 to 12 μm, more preferably from 5 to 11 μm, further more preferably from 6 to 10 μm, from the viewpoint of image reproducibility.

If the volume average particle diameter (Dv) of the colored resin particles is less than the above range, flowability of the toner lowers, a deterioration in image quality due to fog or the like is likely to occur, and adverse effect on printing performance may be caused. On the other hand, if the volume average particle diameter (Dv) of the colored resin particles exceeds the above range, the resolution of images to be obtained tends to decrease, and adverse effect on printing performance may be caused.

As for the colored resin particles, a particle size distribution (Dv/Dn), which is a ratio of the volume average particle diameter (Dv) and the number average particle diameter (Dn), is preferably in the range from 1.0 to 1.3, more preferably from 1.0 to 1.25, further more preferably from 1.0 to 1.2 from the viewpoint of image reproducibility.

If the (Dv/Dn) of the colored resin particles exceeds the above range, flowability of the toner lowers, a deterioration in image quality due to fog or the like is likely to occur, and adverse effect on printing performance may be caused.

The value of the volume average particle diameter (Dv) and the number average particle diameter (Dn) of the colored resin particles can be measured by means of a particle diameter measuring device.

As a method for measuring the volume average particle diameter (Dv) and a method for calculating the particle size distribution (Dv/Dn), the following method can be exemplified. The method for measuring Dv and the method for calculating Dv/Dn are not necessarily limited to the following method.

First, about 0.1 g of colored resin particles is weighed out and placed in a beaker. Then, 0.1 mL aqueous solution of alkyl benzene sulfonate (product name: DRIWEL; manufactured by: FUJIFILM Corporation) is added therein as a dispersant. Further, from 10 to 30 mL of ISOTON II is added to the beaker and dispersed by means of an ultrasonic disperser at 20 W (watts) for 3 minutes. Then, the volume average particle diameter (Dv) and number average particle diameter (Dn) of the colored resin particles are measured by means of a particle diameter measuring device (product name: MULTISIZER; manufactured by: Beckman Coulter, Inc.) under the condition of an aperture diameter of 100 μm, using ISOTON II as a medium, and a number of the measured particles of 100,000. Therefrom, the particle size distribution (Dv/Dn) is calculated.

In the present invention, the colored resin particles can be used as a toner without any change. From the viewpoint of controlling the charging ability, flowability and shelf stability of the toner, the colored resin particles may be mixed and agitated together with an external additive; thus, the external additive is attached on the surface of the colored resin particles to form a one-component toner.

The one-component toner may be mixed and agitated together with carrier particles to form a two-component developer.

Examples of the external additive include: inorganic particles comprising silica, titanium oxide, aluminum oxide, zinc oxide, tin oxide, calcium carbonate, calcium phosphate and/or cerium oxide; and organic particles comprising a polymethylmethacrylate resin, silicone resin and/or melamine resin. Among them, inorganic particles are preferable. Among the inorganic particles, silica and/or titanium oxide is preferable, and particles comprising silica are more preferable.

These external additives are used alone or in combination of two or more kinds.

In the present invention, it is desirable that the amount of the external additive to be used is generally in the range from 0.05 to 6 parts by weight, preferably from 0.2 to 5 parts by weight, with respect to 100 parts by weight of the colored resin particles. If the added amount of the external additive is less than 0.05 part by weight, the toner after transfer may be remained. If the added amount of the external additive exceeds 6 parts by weight, fog may occur.

EXAMPLE

Hereinafter, a specific embodiment of the present invention will be described further in detail with reference to Examples. However, the specific embodiment of the present invention is not limited to the following examples and can be modified within the scope of the invention. Herein, "part(s)" and "%" are based on weight if not particularly mentioned.

1. Production of Wax

<Natural Sunflower Wax (1)>

A crude sunflower oil obtained by pressing sunflower seeds was gradually cooled to 0° C. to precipitate a crude wax contained in the crude sunflower oil. Then, a crude wax precipitate was collected by filtration.

Thus obtained crude wax precipitate was mixed with n-hexane to extract a major component of the wax in n-hexane, and impurities were separated by filtration. Then, n-hexane in a filtrate was removed to obtain a wax concentrate.

Furthermore, after thus obtained wax concentrate was melted and mixed with methanol, the resultant was gradually cooled to precipitate a crystal of the wax. Thus obtained wax crystal was separated by filtration, and a solvent was removed. Thereby, a wax composition was obtained.

Thus obtained wax composition was washed with methanol three times, and white clay was added therein so that a ratio of the white clay was 1 to 10% with respect to the wax composition. Then, the resultant was agitated for 10 to 15 minutes at 90 to 100° C. to remove impurities by adsorption.

The wax excluding the impurities was treated while the temperature was gradually raised by means of a molecular distillation apparatus under high vacuum (0.005 Torr or less at an absolute pressure) and high temperature (120 to 230° C.) to remove a distillate. Thereby, natural sunflower wax (1) was obtained at yield of 80%.

<Natural Sunflower Wax (2)>

Until the process of adding the white clay in the wax composition and removing the impurities by adsorption in natural sunflower wax (2) was the same as that of natural sunflower wax (1). In the production process of natural sunflower wax (2), distillation using the molecular distillation apparatus was not performed.

2. Analysis of Waxes

The acid value, the hydroxyl group value, melting point (TmD) and half-value width of the above two kinds of natural sunflower waxes, a commercially available natural carnauba wax (product name: Refined carnauba wax No. 1; manufactured by: CERARICA NODA CO., Ltd.) and a commercially available natural candelilla wax (product name: Refined candelilla wax special; manufactured by: CERARICA NODA CO., Ltd.) were measured.

2-1. Measurement of Acid Value of Wax

The acid value of the wax was measured with reference to JOCS 2.3.1-96, which is a Standard Method for the Analysis of Fats, Oils and Related Materials defined by Japan Oil Chemists' Society (JOCS).

2-2. Measurement of Hydroxyl Group Value of Wax

The hydroxyl group value of the wax was measured with reference to JOCS 2.3.6.2-96, which is a Standard Method for the Analysis of Fats, Oils and Related Materials defined by Japan Oil Chemists' Society (JOCS).

2-3. Measurement of Melting Point (TmD) and Half-Value Width of Wax 6 to 8 mg of a test sample (wax) was weighed out in a sample holder, and measured by means of a Differential Scanning calorimetry (product name: RDC-220; manufactured by: Seiko Instruments Inc.) under the condition that a temperature was increased in the range from −20° C. to 100° C. at a rate of 10° C./minute. Thereby, a DSC curve was obtained. The top of a peak on the DSC curve was defined as a melting point (TmD), and a half-value width of the peak on the DSC curve was calculated. If there are multiple peaks on the DSC curve, the melting point (TmD) and the half-value width were calculated from the top of the maximum peak.

The acid value, melting point (TmD) and half-value width of the peak on the DSC curve of each of the above-described two kinds of natural sunflower waxes and the above-described various kinds of commercial available natural waxes are shown in Table 1. The peaks of the carbon atoms attributed to aliphatic alcohol and fatty acid are also shown in Table 1.

Although it is not shown in Table 1, the hydroxyl group value of natural sunflower wax (1) was 2 mg KOH/g and the hydroxyl group value of natural sunflower wax (2) was 5 mg KOH/g.

TABLE 1

| | Sunflower wax (1) | Sunflower wax (2) | Carnauba wax | Candelilla wax |
|---|---|---|---|---|
| Peak of carbon atom attributed to aliphatic alcohol | C24 to 28 | C24 to 28 | C30 to 34 | C30 to 34 |
| Peak of carbon atom attributed to fatty acid | C20 to 24 | C20 to 24 | C20 to 28 | C20, 32 to 34 |
| Acid value (mg KOH/g) | 2 | 5 | 3 | 19 |
| Melting point TmD (° C.) | 78 | 78 | 83 | 71 |
| Half-value width of peak on DSC curve (° C.) | 5.5 | 7.0 | 10 | 10 |

3. Production of Toner for Developing Electrostatic Images

Colored resin particles (1) to (7) were produced using the above-described two kinds of natural sunflower waxes and/or various kinds of commercial available natural waxes.

<Colored Resin Particles (1)>

3-1. Preparation of Polymerizable Monomer Composition for Core

Polymerizable monomer for core comprising 77 parts of styrene and 23 parts of n-butyl acrylate, 0.25 part of polymethacrylic acid ester macromonomer (product name: AA6; manufactured by: Toagosei Co., Ltd.) as a macromonomer, 7 parts of carbon black (product name: #25B; manufactured by: Mitsubishi Chemical Corporation) and 0.75 part of a charge control resin having positively charging ability (product name: FCA-592P; manufactured by: Fujikura Kasei Co., Ltd.; a quaternary ammonium salt group-containing styrene/acrylate resin) were agitated by means of an agitator furnished with an agitating blade to mix followed by uniform dispersion by means of a media type dispersing machine. Thereto, 5 parts of natural sunflower wax (1) and 3 parts of a petroleum wax (product name: HNP-11; manufactured by: Nippon Seiro Co., Ltd.; melting point: 68° C.) were added, mixed and dissolved. Thus, a polymerizable monomer composition for core was obtained.

3-2. Preparation of Aqueous Dispersion Medium

An aqueous solution of 5 parts of sodium hydroxide (alkali metal hydroxide) dissolved in 45 parts of ion-exchanged water was gradually added to an aqueous solution of 10 parts of magnesium chloride (water-soluble polyvalent metallic salt) dissolved in 240 parts of ion-exchanged water at 25° C. while agitating to prepare a magnesium hydroxide colloid (hardly water-soluble metal hydroxide colloid) dispersion liquid. The particle size distribution of thus obtained colloid was measured by means of a particle size analyzer (product name: SALD Particle Size Analyzer; manufactured by: Shimadzu Corporation) and $D_{50}$ (50% cumulative value of number particle size distribution) was 0.36 μm and $D_{90}$ (90% cumulative value of number particle size distribution) was 0.80 μm.

3-3. Process for Forming Droplets

The polymerizable monomer composition for core was added to the above-obtained magnesium hydroxide colloid dispersion liquid and agitated at 45° C. by means of an agitator furnished with an agitating blade until coarse droplets to be produced were stable. Thereto, 4.4 parts of t-butylperoxy diethylacetate as a polymerization initiator, 1.0 part of tetraethyl thiuram disulfide (TETD) as a molecular weight modifier and 0.5 part of divinylbenzene as a crosslinkable polymerizable monomer were added. Then, the mixture was subjected to a high shear agitation at 15,000 rpm for 5 minutes by means of a high shear agitator (product name: EBARA MILDER; manufactured by Ebara Corporation). Thus, droplets of the polymerizable monomer composition were formed.

3-4. Preparation of Polymerizable Monomer for Shell 1.5 parts of methyl methacrylate as a polymerizable monomer for shell, and a solution of 0.1 part of 2,2'-azobis-(2-methyl-N-(2-hydroxyethyl)propionamide) (product name: VA086; manufactured by: Wako Pure Chemical Industries, Ltd.) as a water-soluble polymerization initiator dissolved in 10 parts of ion-exchanged water were prepared, respectively.

3-5. Suspension Polymerization Process

A reactor equipped with an agitator furnished with an agitating blade was prepared. Into this reactor, an aqueous dispersion in which the droplets of the polymerizable monomer for core were dispersed was charged.

The dispersion inside of the reactor was heated to 90° C. with a jacket furnished with the outside of the reactor to start a polymerization reaction of the polymerizable monomer composition for core. When the polymerization conversion rate reached 95%, the polymerizable monomer for shell and the water-soluble polymerization initiator for shell were added in the reactor while keeping the temperature inside of the reactor at 90° C. After continuing the polymerization reaction for another 3 hours by keeping the temperature inside of the reactor at 90° C., cooling water was injected into the jacket to decrease the temperature inside of the reactor to about 25° C., thereby stopping the polymerization reaction. By the above operations, an aqueous dispersion containing produced core-shell type colored resin particles was obtained in the reactor.

3-6. Posttreatment Process

Thus obtained aqueous dispersion containing the colored resin particles was subjected to a stripping treatment. First, to the obtained aqueous dispersion containing the colored resin particles, 1 part of non-silicone defoaming agent (product name: SN Defoamer 180; manufactured by: SUN NOPCO LIMITED) was added. Nitrogen gas was injected into the reactor, and the air layer of the reactor was replaced with the nitrogen gas. Next, the aqueous dispersion containing the colored resin particles was heated to 90° C., and nitrogen gas was injected into the aqueous dispersion through a gas blowing tube having a straight tube-shaped gas blowing port for 6 hours to remove a volatile substance in the dispersion. Then, the aqueous dispersion containing the colored resin particles was cooled to 25° C. by charging cooling water into the jacket.

The aqueous dispersion containing the colored resin particles after cooling was subjected to acid washing in which sulfuric acid was added to neutralize pH of the dispersion to 4.5 while agitating. From the neutralized aqueous dispersion containing the colored resin particles, wet-state colored resin particles were separated by filtration. Then, another 500 parts of ion-exchange water was added therein to make a slurry of the wet-state colored resin particles again, and separation by filtration was performed again. The slurry and separation by filtration were repeatedly performed three times, thus the wet-state colored resin particles were washed with water.

The wet-state colored resin particles after washing with water were dried at 40° C. for 72 hours by means of a vacuum drier. Thus, dried core-shell type colored resin particles (1) were obtained.

<Colored Resin Particles (2)>

Colored resin particles (2) were obtained similarly as in the production method of colored resin particles (1) except that 3 parts of the petroleum wax was changed to 3 parts of a synthetic ester wax (product name: WEP-7; manufactured by: NOF Corporation; melting point: 70° C.) in the "3-1. Preparation of polymerizable monomer composition for core".

<Colored Resin Particles (3)>

Colored resin particles (3) were obtained similarly as in the production method of colored resin particles (1) except that the added amount of the petroleum wax was changed to 2 parts, and 1 part of a synthetic ester wax (product name: WEP-7; manufactured by: NOF Corporation) was further added in the "3-1. Preparation of Polymerizable Monomer Composition for core".

<Colored Resin Particles (4)>

Colored resin particles (4) were obtained similarly as in the production method of colored resin particles (1) except that 5 parts of natural sunflower wax (1) was changed to 5 parts of natural sunflower wax (2) in the "3-1. Preparation of polymerizable monomer composition for core".

<Colored Resin Particles (5)>

Colored resin particles (5) were obtained similarly as in the production method of colored resin particles (1) except that 5 parts of natural sunflower wax (1) was changed to 5 parts of a commercially available carnauba wax (product name: Refined carnauba wax No. 1; manufacture by: CERARICA NODA CO., Ltd.) in the "3-1. Preparation of polymerizable monomer composition for core".

<Colored Resin Particles (6)>

Colored resin particles (6) were obtained similarly as in the production method of colored resin particles (1) except that 5 parts of natural sunflower wax (1) was changed to 5 parts of a commercially available candelilla wax (product name: Refined candelilla wax special; manufacture by: CERARICA NODA CO., Ltd.) in the "3-1. Preparation of polymerizable monomer composition for core".

<Colored Resin Particles (7)>

Colored resin particles (7) were obtained similarly as in the production method of colored resin particles (1) except that natural sunflower wax (1) was not used, the added amount of the petroleum wax was changed to 5 parts, and 3 parts of a synthetic ester wax (product name: WEP-7; manufactured by: NOF Corporation) was further added in the "3-1. Preparation of Polymerizable Monomer Composition for core".

4. Property Evaluation of Colored Resin Particles

The volume average particle diameter (Dv) of each of colored resin particles (1) to (7) was measured, and the particle size distribution (Dv/Dn) of each of colored resin particles (1) to (7) was calculated.

About 0.1 g of each of colored resin particles (1) to (7) was weighed out and placed in a beaker. Then, 0.1 mL aqueous solution of alkyl benzene sulfonate (product name: DRI-WEL; manufactured by FUJIFILM Corporation) was added therein as a dispersant. Further, from 10 to 30 mL of ISOTON II was added to the beaker and dispersed by means of an ultrasonic disperser at 20 W (watts) for 3 minutes. Then, the volume average particle diameter (Dv) and number average particle diameter (Dn) of each of colored resin particles (1) to (7) were measured by means of a particle diameter measuring device (product name: MULTISIZER; manufactured by Beckman Coulter, Inc.) under the condition of an aperture diameter of 100 μm, using ISOTON II as a medium, and a number of the measured particles of 100,000. Therefrom, the particle size distribution (Dv/Dn) was calculated.

The property evaluations of colored resin particles (1) to (7) are shown in Table 2, together with wax compositions of colored resin particles (1) to (7).

TABLE 2

| | | Colored resin particles (1) | Colored resin particles (2) | Colored resin particles (3) | Colored resin particles (4) | Colored resin particles (5) | Colored resin particles (6) | Colored resin particles (7) |
|---|---|---|---|---|---|---|---|---|
| Natural wax | Type | Sunflower wax (1) | Sunflower wax (1) | Sunflower wax (1) | Sunflower wax (2) | Carnauba wax | Candelilla wax | — |
| | Added amount (parts by weight) | 5 | 5 | 5 | 5 | 5 | 5 | — |
| Petroleum wax | Type | HNP-11 | — | HNP-11 | HNP-11 | HNP-11 | HNP-11 | HNP-11 |
| | Added amount (parts by weight) | 3 | — | 2 | 3 | 3 | 3 | 5 |
| Synthetic ester wax | Type | — | WEP-7 | WEP-7 | — | — | — | WEP-7 |
| | Added amount (parts by weight) | — | 3 | 1 | — | — | — | 3 |
| Volume average particle diameter (Dv) (μm) | | 7.6 | 7.5 | 7.7 | 7.4 | 7.7 | 7.6 | 7.5 |
| Particle size distribution (Dv/Dn) | | 1.20 | 1.18 | 1.21 | 1.28 | 1.30 | 1.34 | 1.20 |

5. Production of Toner for Developing Electrostatic Images

External additives were externally added to the above-described colored resin particles (1) to (7). Thus, toners for developing electrostatic images of Examples 1 to 4 and Comparative Examples 1 to 3 were produced.

Example 1

To 100 parts of colored resin particles (1), 0.6 part of hydrophobized silica particles (1) (product name: TG820F; manufactured by: Cabot corporation) and 1 part of hydrophobized silica particles (2) (product name: NA50Y; manufactured by: Nippon Aerosil Co., Ltd.) were added to mix by means of the Henschel Mixer. Thus, a toner for developing electrostatic images of Example 1 was obtained.

Example 2

A toner for developing electrostatic images of Example 2 was obtained similarly as in Example 1 except that colored resin particles (1) were changed to colored resin particles (2).

Example 3

A toner for developing electrostatic images of Example 3 was obtained similarly as in Example 1 except that colored resin particles (1) were changed to colored resin particles (3).

Example 4

A toner for developing electrostatic images of Example 4 was obtained similarly as in Example 1 except that colored resin particles (1) were changed to colored resin particles (4).

Comparative Example 1

A toner for developing electrostatic images of Comparative Example 1 was obtained similarly as in Example 1 except that colored resin particles (1) were changed to colored resin particles (5).

Comparative Example 2

A toner for developing electrostatic images of Comparative Example 2 was obtained similarly as in Example 1 except that colored resin particles (1) was changed to colored resin particles (6).

Comparative Example 3

A toner for developing electrostatic images of Comparative Example 3 was obtained similarly as in Example 1 except that colored resin particles (1) were changed to colored resin particles (7).

6. Evaluation of Toner for Developing Electrostatic Images

The characteristics of the toner for developing electrostatic images of Examples 1 to 4 and Comparative Examples 1 to 3 were measured and evaluated. As the characteristics of the toner, the minimum fixing temperature and the limit peeling temperature were measured, and shelf stability, durability under a normal temperature and normal humidity environment (N/N), durability after being left at high temperature and thin line reproducibility were evaluated.

6-1. Measurement of Minimum Fixing Temperature

A commercially available color printer of the non-magnetic one-component developing method (printing speed=20 prints/minute), which was refurbished so that the temperature of a fixing roller section of the printer could be changed, was used for a fixing test. In the fixing test, the temperature of the fixing roller in the refurbished printer was changed, and the fixing rate of the toner for developing electrostatic images was measured at each temperature to determine the relationship between the temperature and fixing rate.

The fixing roller was left for 5 minutes or more to stabilize the temperature of the fixing roller. After changing the temperature, the solid patterned image on the test paper was printed by the refurbished printer. The fixing rate was calculated from the ratio of image density of solid patterned area before and after tape removing operation based on the following calculating formula. The tape removing operation means a series of operations including: attaching an adhesive tape (product name: SCOTCH MENDING TAPE 810-3-18; manufactured by Sumitomo 3M Limited) to a measuring part of a test paper to be adhered by pressure at a constant pressure; and removing the adhesive tape in a direction along the paper at a constant rate. The image density was measured by means of a reflection image densitometer (product name: RD914; manufactured by Gretag Macbeth Co.).

$$\text{Fixing rate}(\%)=(\text{ID(after)}/\text{ID(before)})\times 100$$

ID (before): image density before removing tape

ID (after): image density after removing tape

In the above fixing test, the fixing roller temperature at which the fixing rate is 80% was referred to as the fixing temperature of the toner for developing electrostatic images.

6-2. Measurement of Limit Peeling Temperature

A commercially available color printer of the non-magnetic one-component developing method (printing speed=20 prints/minute), which was equipped with a plate for separating a recording medium and a fixing roller, was refurbished so that the temperature of a fixing roller surface of the printer could be changed. The refurbished printer was used for a peeling test. In the peeling test, the temperature of the fixing roller in the refurbished printer was changed from 150° C. to 200° C., and the printing test was performed under the normal temperature and normal humidity environment (N/N) having a temperature of 23° C. and a relative humidity of 50%. The temperature at which peeling failure was caused upon printing of 10 prints was referred as to a limit peeling temperature. The peeling failure means that the recording medium was twined around the fixing roller without being peeled from the fixing roller to be clogged, or that a trace of the separating plate was confirmed on the recording medium surface.

In Table 3, "200<" means that peeling failure was not caused even though the temperature of the fixing roller in the refurbished printer was 200° C.

6-3. Evaluation of Shelf Stability 10 g of a toner for developing electrostatic images was placed in a sealable polyethylene container (capacity: 100 mL), and the container was sealed. Then, the container was set in a constant temperature water bath which is maintained at a temperature of 55° C. After 8 hours, the container was removed from the constant temperature water bath, and the toner in the container was put on a 42-mesh sieve. At this time, the toner was gently removed from the container and carefully put on the sieve so as not to destroy the aggregation structure of the toner in the container. The sieve on which the toner was put was vibrated for 30 seconds under the condition of amplitude of 1 mm by means of a powder characteristic tester (product name: POWDER TESTER PT-R; manufactured by Hosokawa Micron Corporation). Thereafter, the weight of the toner remained on the sieve was measured, and the thus-measured toner was referred to as an aggregated toner weight. The ratio (% by weight) of the aggregated toner weight to the toner weight which was firstly placed in the container was calculated.

The above measurement was performed three times per sample to calculate the ratio (% by weight) of the aggregated toner weight, and the mean value of thus obtained ratio was referred to as an indicator of shelf stability.

6-4. Durability Test

A commercially available color printer of the non-magnetic one-component developing method (printing speed=20 prints/minute) was used for a durability test. A toner was charged in a toner cartridge of a development device of the printer and printing paper was set in the printer. After the printer was left under the normal temperature and normal humidity environment (N/N) having a temperature of 23° C. and a humidity of 50% for 24 hours, continuous printing with 5% image density was performed up to 10,000 prints under the N/N environment.

A solid patterned image with 100% image density was printed every 500 prints and the image density of the solid patterned image was measured by means of a reflection image densitometer (product name: RD914; manufactured by Gretag Macbeth Co.). Further, after a solid patterned image with 0% image density was printed with the printer followed by stopping the printer in mid-course of solid pattern printing, the toner remained in a non-image area on the photosensitive member after development was attached to an adhesive tape (product name: SCOTCH MENDING TAPE 810-3-18; manufactured by Sumitomo 3M Limited) and peeled. The tape was attached to a printing paper. Then, the whiteness (B) of the printing paper with the adhesive tape was measured by means of a whiteness colorimeter (product name: ND-1; manufactured by NIPPON DENSHOKU INDUSTRIES CO., LTD.). Similarly, an unused tape was attached to a printing paper to measure the whiteness (A). The difference of these whiteness (B−A) was referred to as a fog value. The smaller fog value means that the less fog is produced and the more excellent image quality is. The number of prints by continuous printing which can maintain a fog value of 1 or less was counted.

6-5. Test of Durability After Being Left at High Temperature

A toner for developing electrostatic images was placed in a sealable container under the environment having a temperature of 23° C. and humidity of 50%, and the container was sealed. After the container was maintained for 5 days under the environment having a temperature of 50° C., the container was opened, and then set back in the N/N environment having a temperature of 23° C. and a humidity of 50%. The toner for developing electrostatic images was removed from the container, and the number of prints by continuous printing which can maintain a fog value of 1 or less was counted using the toner for developing electrostatic images similarly as in the method in the "6-4. Durability test".

6-6. Test of Thin Line Reproducibility

A commercially available color printer of the non-magnetic one-component developing method (printing speed=20 prints/minute) was used for a test of thin line reproducibility. A toner used for the test was charged in a development device of the printer and printing paper was set in the printer. After the printer was left under the normal temperature and normal humidity environment (N/N) having a temperature of 23° C. and a relative humidity of 50% for 24 hours, line images with 2×2 dotline (width: about 85 μm) were continuously formed, and the concentration distribution data of the line images was measured every 500 prints by means of a printing evaluation system (product name: RT2000; manufactured by YA-MA, Inc.). In the evaluation, when defining the full width of an line image having a concentration being half-value width of the maximum concentration in the measured concentration distribution data of line images as a line width, and using a line width of firstly formed line image as a criterion, the line image having a difference between the line width and the criterion line width to be 10 μm or less was defined as reproducing a first line image. The number of prints, which can maintain the difference between the line width and the criterion line width to be 10 μm or less, was counted up to 10,000 prints.

In Table 3, "10000<" means that the above criterion was satisfied even though 10,000 line images were continuously printed.

Measurement and evaluation results of the toner for developing electrostatic images of Examples 1 to 4 and Comparative Examples 1 to 3 are shown in Table 3, together with the wax compositions of toners.

TABLE 3

| | | Example 1 | Example 2 | Example 3 | Example 4 | Comparative Example 1 | Comparative Example 2 | Comparative Example 3 |
|---|---|---|---|---|---|---|---|---|
| Natural wax | Type | Sunflower wax (1) | Sunflower wax (1) | Sunflower wax (1) | Sunflower wax (2) | Carnauba wax | Candelilla wax | — |
| | Added amount (parts by weight) | 5 | 5 | 5 | 5 | 5 | 5 | — |
| Petroleum wax | Type | HNP-11 | — | HNP-11 | HNP-11 | HNP-11 | HNP-11 | HNP-11 |
| | Added amount (parts by weight) | 3 | — | 2 | 3 | 3 | 3 | 5 |
| Synthetic ester wax | Type | — | WEP-7 | WEP-7 | — | — | — | WEP-7 |
| | Added amount (parts by weight) | — | 3 | 1 | — | — | — | 3 |
| Minimum fixing temperature (° C.) | | 140 | 145 | 135 | 140 | 155 | 150 | 155 |
| Limit peeling temperature (° C.) | | 200 | 200< | 200< | 185 | 185 | 185 | 200< |
| Shelf stability (wt %) | | 1 | 1 | 1 | 1 | 10 | 30 | 1 |
| Durability (prints) | | 10000< | 10000< | 10000< | 10000< | 9000 | 9000 | 10000< |
| Durability after being left at high temperature (prints) | | 10000< | 10000< | 10000< | 8500 | 6500 | 5000 | 10000< |
| Thin line reproducibility (prints) | | 10000< | 10000< | 10000< | 9500 | 7000 | 5000 | 10000< |

7. Summary of Evaluation of Toner for Developing Electrostatic Images

First, the toner of Comparative Example 1 will be reviewed. The minimum fixing temperature of the toner of Comparative Example 1 was 10° C. or more higher than those of the toners of Examples 1 to 4. This is attributed to the fact that the wax having a high melting point (83° C.) such as the natural carnauba wax was used in the toner of Comparative Example 1. The limit peeling temperature of the toner of Comparative Example 1 was less than 200° C. In addition, the ratio of the aggregated toner weight in the toner of Comparative Example 1 was 10 times higher than those in the toners of Examples 1 to 4. The aggregation in the toner of Comparative Example 1 is attributed to the fact that the particle size distribution of the toner was broadened by using the natural carnauba wax containing a low-molecular-weight component. Furthermore, durability under the normal temperature and normal humidity environment, durability after being left at high temperature and thin line reproducibility of the toner of Comparative Example 1 were inferior compared to those of the toners of Examples 1 to 4.

Next, the toner of Comparative Example 2 will be reviewed. The minimum fixing temperature of the toner of Comparative Example 2 was 5° C. or more higher than those of the toners of Examples 1 to 4. The limit peeling temperature of the toner of Comparative Example 2 was less than 200° C. In addition, the ratio of the aggregated toner weight in the toner of Comparative Example 2 was 30 times higher than those in the toners of Examples 1 to 4. The aggregation in the toner of Comparative Example 2 is attributed to the fact that the particle size distribution of the toner was broadened by using the natural candelilla wax containing a low-molecular-weight component. Furthermore, durability under the normal temperature and normal humidity environment, durability after being left at high temperature and thin line reproducibility of the toner of Comparative Example 2 were inferior compared to those of the toners of Examples 1 to 4.

Then, the toner of Comparative Example 3 will be reviewed. The minimum fixing temperature of the toner of Comparative Example 3 was 10° C. or more higher than those of the toners of Examples 1 to 4. This result shows that the toner of Comparative Example 3 containing no natural sunflower wax provides particularly-low fixability.

Relative to the above-described Comparative Examples 1 to 3, the toners of Examples 1 to 4 containing the natural sunflower wax had a minimum fixing temperature of 145° C. or less and a ratio of the aggregated toner in the shelf stability test of 1% by weight, and the result of the durability test under the normal temperature and normal humidity environment was more than 10,000 prints. Especially in the toners of Examples 1 to 3 containing natural sunflower wax (1) in which the distillation was performed, in addition to the above results, a limit peeling temperature was more than 200° C., and both of the test results of durability after being left at high temperature and thin line reproducibility were more than 10,000 prints.

The above results show that the toners of Examples 1 to 4 containing the natural sunflower wax have more excellent fixability, peelability, shelf stability (blocking resistance), printing durability, printing durability after being left at high temperature and thin line reproducibility than the conventional toner containing other natural waxes (Comparative Examples 1 and 2). The above results also show that the toners of Examples 1 to 4 containing the natural sunflower wax have more excellent fixability than the conventional toner containing only the petroleum wax and the synthetic ester wax (Comparative Example 3).

Furthermore, among the toners of Examples 1 to 3, the toner of Example 3 using the natural sunflower wax, the petroleum wax and the synthetic ester wax in combination had the lowest minimum fixing temperature and the highest limit peeling temperature.

The invention claimed is:

1. A toner for developing electrostatic images, comprising colored resin particles comprising a binder resin, a colorant and a wax, wherein the wax contains a natural sunflower wax, and wherein the natural sunflower wax has an acid value of 10 mg KOH/g or less, and a content of the natural sunflower wax is in the range from 1 to 10 parts by weight with respect to 100 parts by weight of the binder resin.

2. The toner for developing electrostatic images according to claim 1, wherein the wax further contains a petroleum wax, and wherein a content of the petroleum wax is in the range from 1 to 10 parts by weight with respect to 100 parts by weight of the binder resin.

3. The toner for developing electrostatic images according to claim 1, wherein the wax further contains a synthetic ester wax, and wherein a content of the synthetic ester wax is in the range from 1 to 10 parts by weight with respect to 100 parts by weight of the binder resin.

4. The toner for developing electrostatic images according to claim 1, wherein the natural sunflower wax has one melting point (TmD) which is defined by an endothermic peak temperature upon temperature rise that is measured by a differential scanning type calorimeter (DSC), and wherein a half-value width of the endothermic peak is 8° C. or less.

5. The toner for developing electrostatic images according to claim 1, wherein the melting point (TmD) of the natural sunflower wax is in the range from 70 to 85° C., the melting point is defined by the endothermic peak temperature upon temperature rise that is measured by the differential scanning type calorimeter (DSC).

6. The toner for developing electrostatic images according to claim 1, wherein the colored resin particles are produced by a wet method.

7. The toner for developing electrostatic images according to claim 1, wherein the colored resin particles have a core-shell structure.

8. The toner for developing electrostatic images according to claim 1, wherein the wax further contains a petroleum wax and a synthetic ester wax, wherein a content of the petroleum wax is in the range from 1 to 10 parts by weight with respect to 100 parts by weight of the binder resin, and wherein a content of the synthetic ester wax is in the range from 1 to 10 parts by weight with respect to 100 parts by weight of the binder resin.

* * * * *